United States Patent [19]

Friedrich

[11] Patent Number: 4,848,615

[45] Date of Patent: Jul. 18, 1989

[54] TAMPER-EVIDENT SNAP TYPE CONTAINER CLOSURE ASSEMBLY

[75] Inventor: Peter W. Friedrich, Jersey City, N.J.

[73] Assignee: The West Company, Phoenixville, Pa.

[21] Appl. No.: 178,617

[22] Filed: Apr. 7, 1988

[51] Int. Cl.[4] ..... B65D 41/48

[52] U.S. Cl. ..... 215/254; 215/224

[58] Field of Search ..... 215/211, 213, 223, 224, 215/225, 254, 256; 220/270

[56] References Cited

U.S. PATENT DOCUMENTS

| | | | |
|---|---|---|---|
| 2,169,686 | 8/1939 | Fabrice | 215/254 |
| 3,170,585 | 2/1965 | O'Donnell | 215/224 |
| 3,393,816 | 7/1968 | Grimm | 215/223 |
| 3,812,994 | 5/1974 | Feldman | 215/256 |
| 4,071,156 | 1/1978 | Lowe | 215/224 |
| 4,573,599 | 3/1986 | Fillmore | 215/256 |

*Primary Examiner*—Donald F. Norton

*Attorney, Agent, or Firm*—Eugene E. Renz, Jr.

[57] ABSTRACT

A tamper-proof closure for a container having a discharge opening at one end and a wall member spanning the opening, inter-engaging locking between the skirt of the cap and the container opening, a tab projecting radially outwardly from the skirt registerable with a recess or gap in a radially outwardly directed flange of the container which it normally overlies, a fracturable tear band portion including inter-locking to prevent relative rotation of the closure and container.

4 Claims, 4 Drawing Sheets

TAMPER-EVIDENT SNAP TYPE CONTAINER CLOSURE ASSEMBLY

FIELD OF THE INVENTION

The present invention relates to improvements in so-called tamper-evident container closures or caps particularly adapted for use in packaging pharmaceutical products.

BACKGROUND OF THE INVENTION

Tamper-evident container closures are not new per se. In the packaging of pharmaceutical products particularly over-the-counter products such as aspirin, and other drugs, it is important that the closure provide visual indicia of once having been opened in order to alert the user to possible tampering of the product in the container. Shrink wraps made of plastic have been employed to seal the juncture of the cap with the container when it is seated on the container. In order to remove the cap which may be a screw-type cap, the shrink wrap has to be physically torn which gives evidence to the user that the cap may have been once removed. It has been found that the process of assembling shrink wraps is relatively expensive. Furthermore, they are not truly tamper-proof in that if there is a loose fit, it presents the danger of the shrink wrapping being removed, tampering of the product and then reapplying the shrink wrap so that there is no visual indicia that the cap has been once opened.

Other types of tamper-proof closures are shown in the patents listed below.

| Inventor | Patent No. | Issue Date | Title of Invention |
|---|---|---|---|
| Fields | 3,224,616 | 12-21-65 | Closure and Method of Making Same |
| Fields | 3,329,295 | 07-04-67 | Tamper-Indicating Closure |
| Fields | 3,438,528 | 04-15-69 | Tamper-Indicating Closure |
| Fields | 3,504,818 | 04-07-70 | Tamper Proof Bottle Closure |
| Fields et al | 3,455,478 | 07-15-69 | Tamper-Indicating Closure |
| Patel et al | 4,147,268 | 04-03-79 | Pilfer-Proof Closure For Containers |
| de Wijn | 4,205,755 | 06-03-80 | Tamper-Proof Bottle Closure |
| Ostrowsky | 4,206,851 | 06-10-80 | Tamperproof Closure |

These closures generally comprise a screw cap made of plastic and having a tamper-evident band connected by fractuable bridges or scoring to the lower terminal edge of the skirt of the cap. The tamper band usually has a rib which coacts and engages under a flange on the container finish. Accordingly, when it is desired to remove the cap, the user simply turns it in the direction to unscrew the cap and the tamper-evident band is prevented from moving axially by reason of the inter-engaging ribs, bead and flange so that as tork is applied to the bridges connecting the tamper-evident band to the skirt fracture allowing the closure to separate from the band and be removed from the container. Thus, when the closure is removed from the container body, the separated band gives indication that the package has once been opened or possibly tampered with. While these closure assemblies are generally effected for the purposes intended, the present invention provides a tamper-evident closure assembly which is of relatively simplified construction, as easy and economical to manufacture and apply to a container and is truly tamper-proof.

SUMMARY OF THE INVENTION

With the foregoing in mind, it is the object of the present invention to provide an improvement in tamper-evident closures which is of relatively simplified construction and is useful for the purposes intended. To this end, the cap seats in the neck of the container in a predetermined fixed non-rotatable position by virtue of a removable portion which has locking elements which interengage with complementary locking elements in the neck of the container. The cap can be removed only by removing the tear-off portion which permits the cap to be rotated to a point where the removal tab aligns with a cut out of gap in a radial flange of the cap and the cap can be pried upwardly.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRD EMBODIMENT

Figure 1:
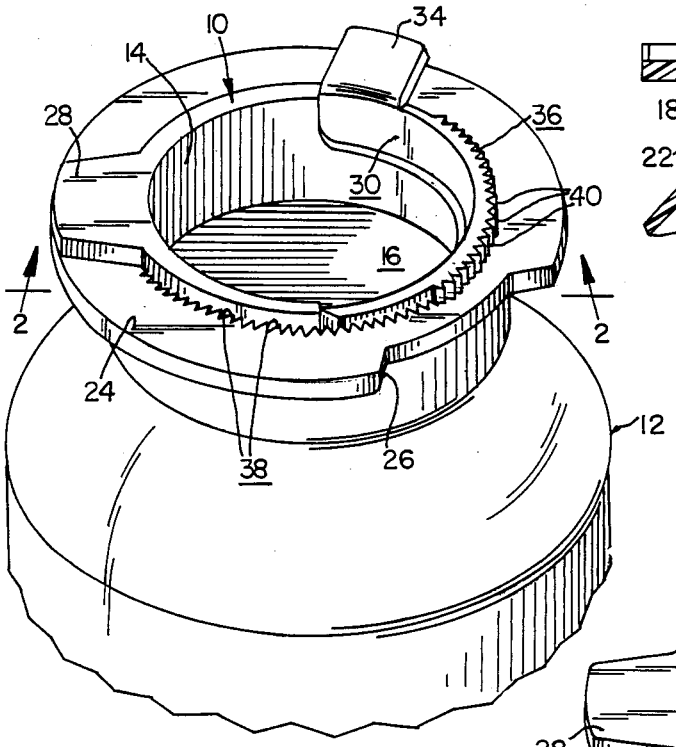
FIG. 1 is a perspective view of a tamper-evident closure in accordance with the present invention.
Figure 2:
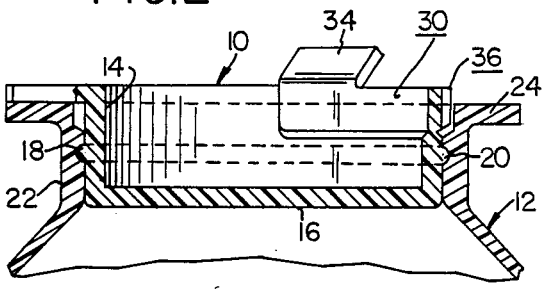
FIG. 2 is a transverse sectional view taken on lines 2—2 of FIG. 1.
Figure 3:
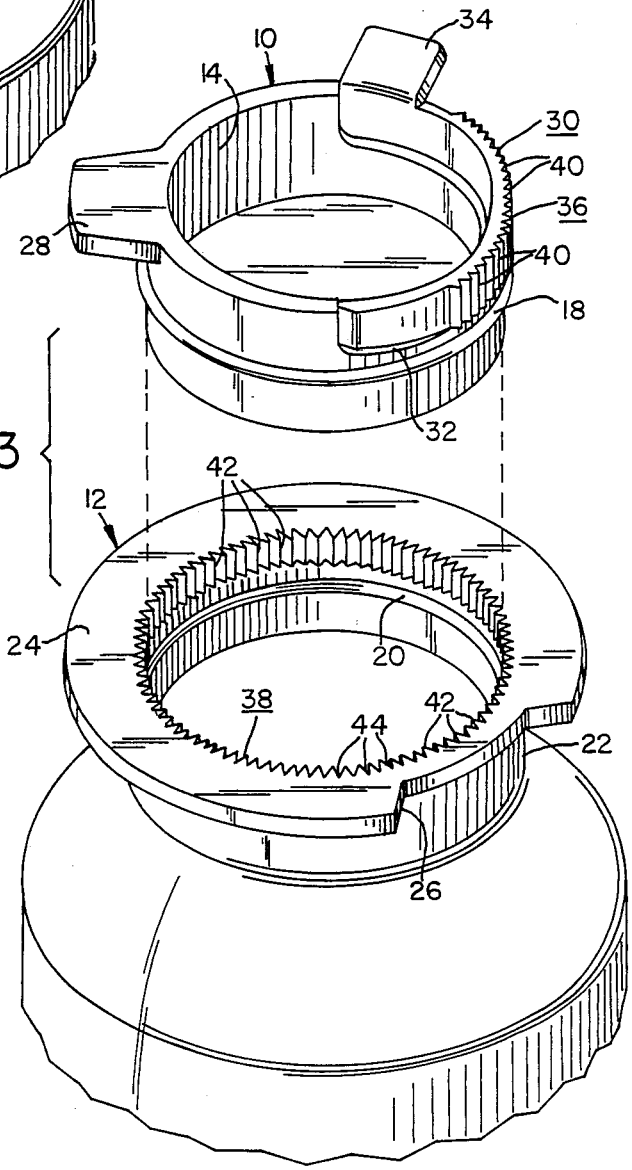
FIG. 3 is an exploded perspective view of a tamper-evident container closure in accordance with the present invention.

Referring now to the drawings and particularly to FIGS. 1–3 thereof, there is illustrated a tamper-evident container-closure assembly in accordance with the present invention. The closure or cap which may be made of a plastic material such as polypropylene is generally designated by the numeral 10 is of cup-like form and is adapted to seat in the mouth of the container 12 and comprises a generally cylindrical sidewall 14, a disc-like bottom 16 and a circumferentially extending radially outwardly directed rib 18 on the sidewall which snap fits into a complementary groove 20 in the inner wall defining the neck 22 of the container to normally seat the cap in place.

The container 12 which also may be made of a plastic material such as polypropylene includes a radially outwardly extending peripheral flange 24 at the discharge opening which has a cutaway segment defining an arcuate gap or recess 26 in the flange 24. The cap 10 has a readially outwardly directed tab 28 which normally overlies the container flange or lip. The cap 10 may be rotated to a position where the tab 28 overlies the gap 26 and in this position the thumb of the user may be placed under the tab 28 to pry it upwardly and effect removal of the cap by a snap-type lever action.

In accordance with the present invention, means is provided for tamper proofing the cap. To this end the cap includes a removable tear band 30 which has means normally preventing rotation of the cap in the container mouth and which upon removal permits rotation of the cap to position the tab in alignment with the gap or recess for removal as described above. More specifically, the tear band as illustrated is formed integrally with the sidewall of the cap and is defined by a partial score line 32 removably connecting the tear band to the sidewall of the cap. The tear band 30 includes a tab 34 at one end thereof which projects upwardly at an angle relative to the cap flange to facilitate gripping by the user when it is desired to remove the tear band 30. The tear band and inner wall of the mouth of the container have interengaging locking means in the present instance in the form of interengaging complementary locking teeth 36 and 38. In the illustrated embodiment, the outer face of the tear band 30 confronting the inner sidewall of the container mouth is of a sawtooth configuration defining a series of axially extending projections or ribs 40 which engage in a complementary sawtooth configuration in the mouth of the container defining a series of projections 42 and grooves 44 intermediate the projections within which the ribs 40 of the sawtooth configuration of the tear band snugly nest or seat.

Figure 4:
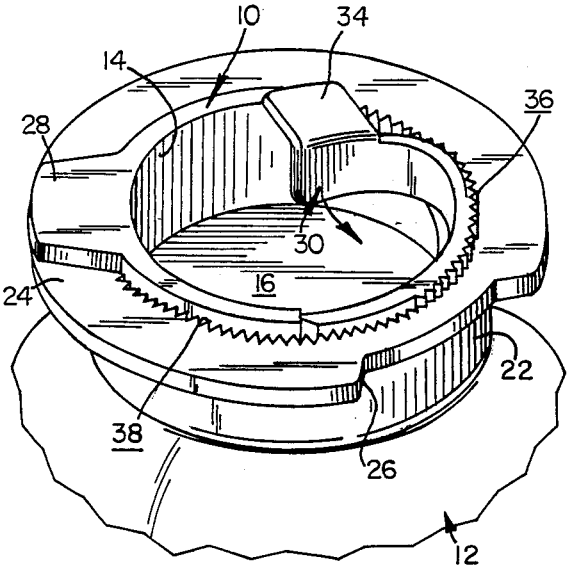
FIGS. 4 and 5 are perspective views illustrating removal of the tear strip.
Figure 5:
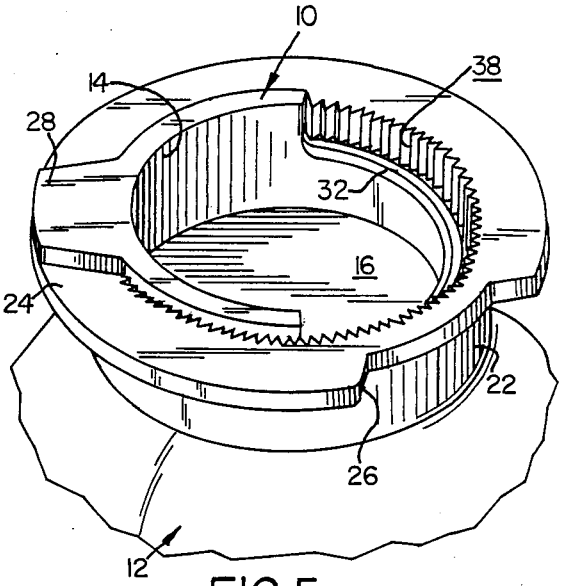
Figure 6:
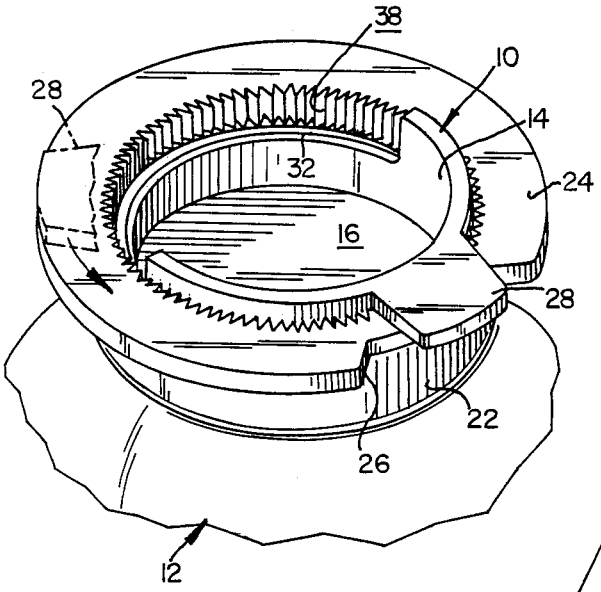
FIG. 6 is a perspective view showing the tamper-evident cap rotated to a position for removal from the container.
Figure 7:
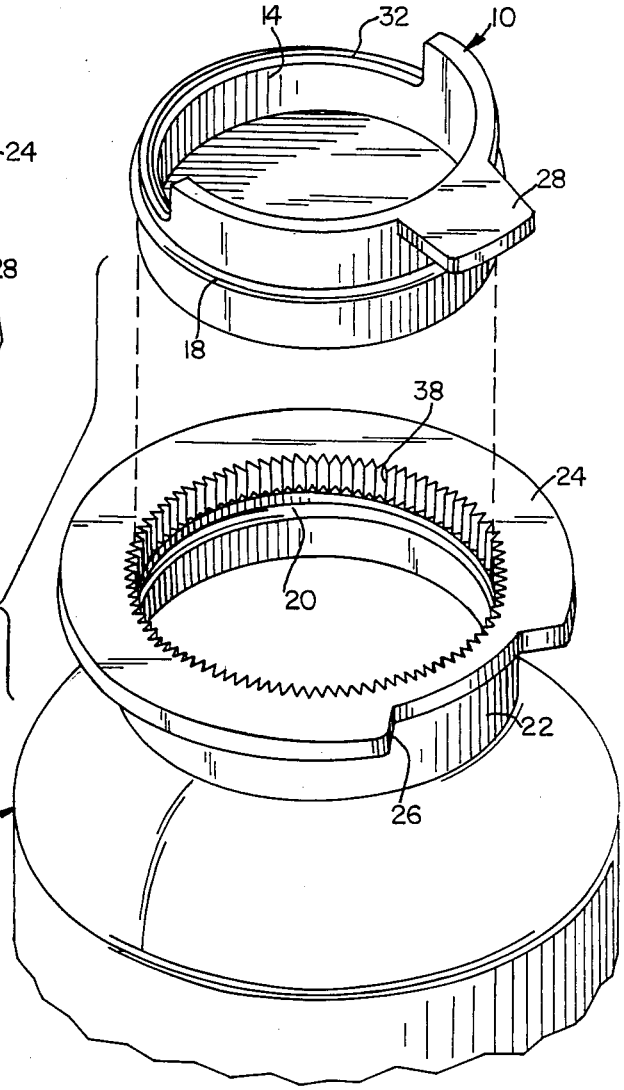
FIG. 7 is an exploded perspective view showing the tamper-evident cap removed.
Figure 8:
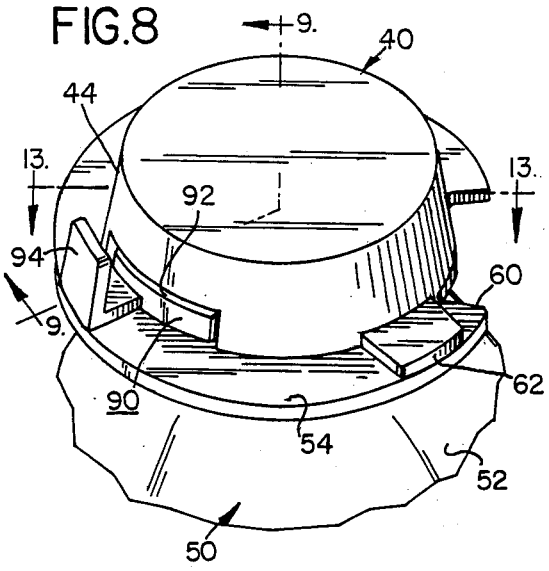
FIG. 8 is a perspective view of another embodiment of tamper-evident closure in accordance with the present invention.
Figure 9:
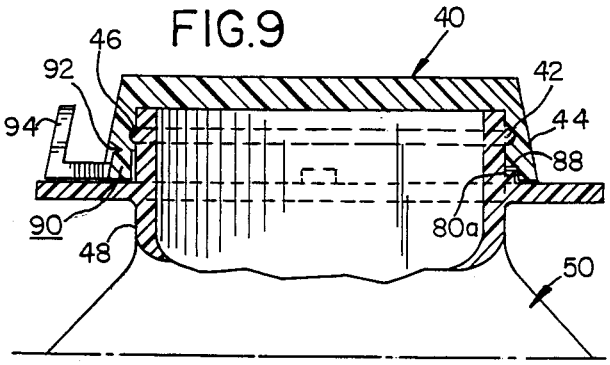
FIG. 9 is a sectional view taken along lines 9—9 of FIG. 8.
Figure 10:
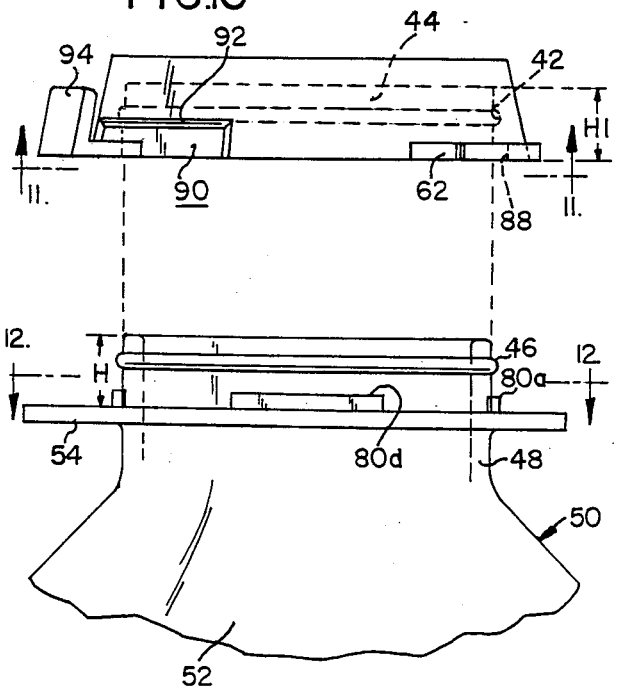
FIG. 10 is a side elevational view of the closure and container.
Figure 11:
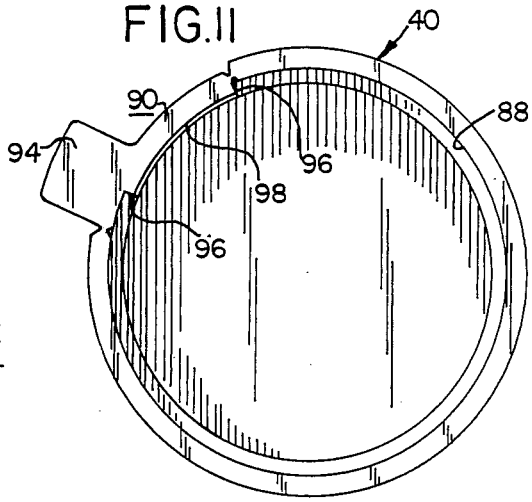
FIGS. 11 and 12 are views taken on lines 11—11 and 12—12 of FIG. 10.
Figure 12:
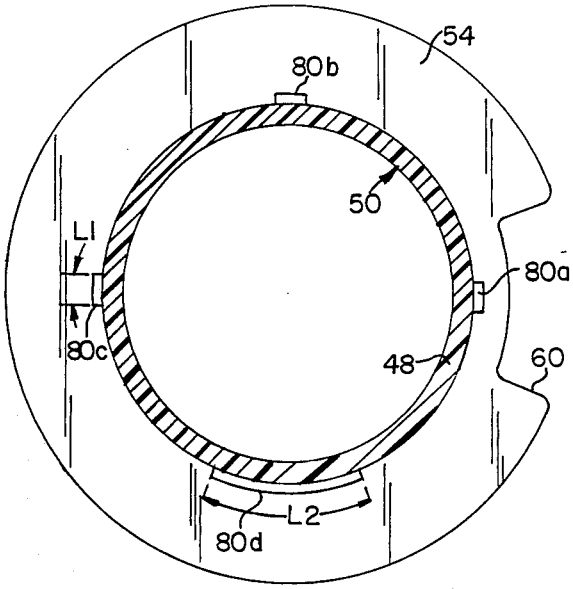
Figure 13:
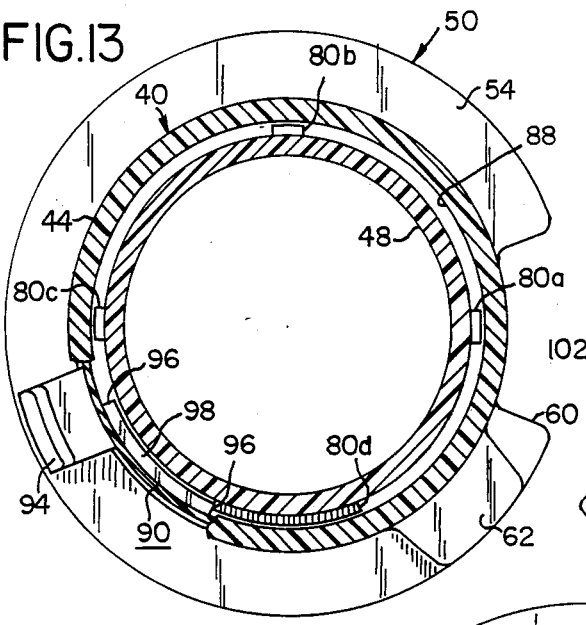
FIGS. 13–17 inclusive are developed views showing various positions of the cap and closure for positioning the cap relative to the container so that it can be removed.
Figure 14:
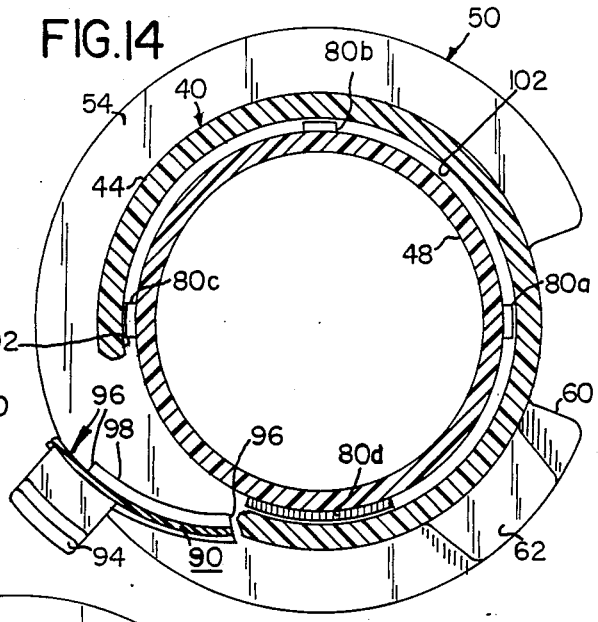
Figure 15:
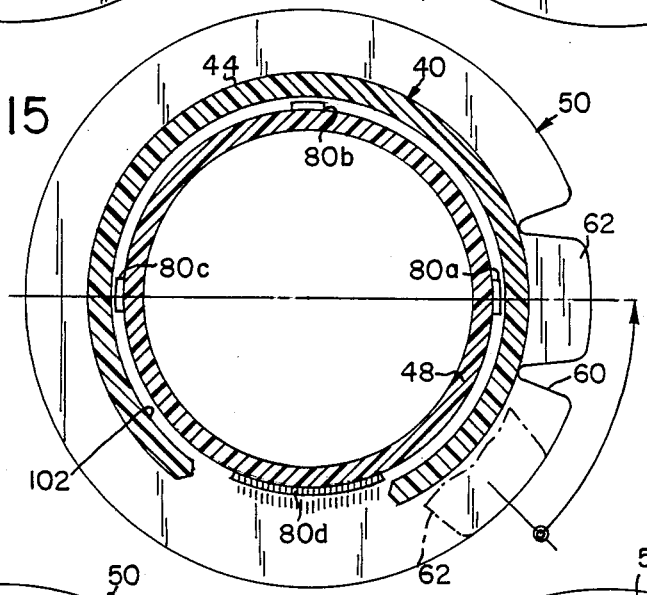
Figure 16:
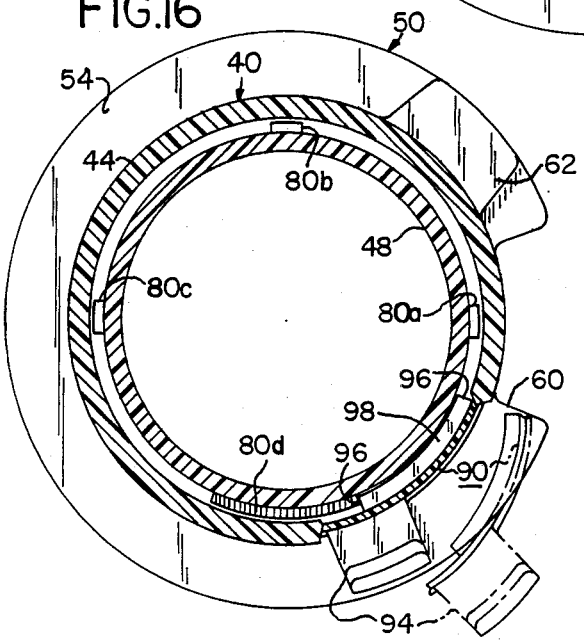
Figure 17:
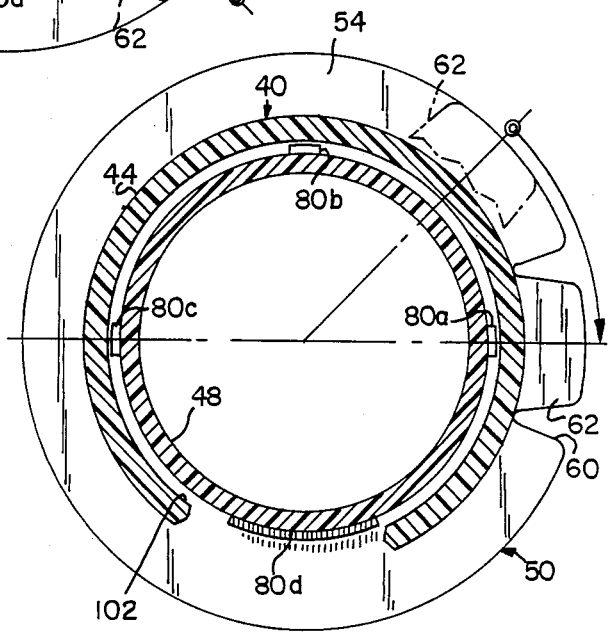

The cap container may be manufactured and assembled very economically. Both cap and container may be molded from a plastic material such as polypropylene. After the container has been filled with a pharmaceutical product in pill, capsule, or liquid form, the cap is simply positioned over the mouth of the container and pressed inwardly until the circumferentially extending rib 18 of the cap seats inthe groove 20 to lock the cap in place. Note that in this position the removal tab 28 is angularly displaced relative to the recess or gap 26. Now when it is desired to remove the cap, the angled tab 34 for the tear band 30 is simply gripped by the user and rotated inwardly in the direction of the arrow in FIG. 4 to sever the tear tab from the remainder of the cap along the score line 32. In this positin the cap may now be easily rotated relative to the container since the locking means has been removed. When the cap is rotated to a position where the removable tab 28 overlies the gap 26, the user may simply pry the cap upwardly by using the thumb to gain access to the contents. Note that the construction is truly tamper-evident since the user at a glance can determine whether the cap has been once removed by the presence of the tear band intact or the absence thereof.

There is illustrated in FIGS. 8–17 another embodiment of tamper-evident container-closure assembly in accordance with the present invention. The cap which is generally designed by the numeral 40 is of inverted cup-like form and has a circumferentially extending groove 42 on the inner face of the skirt 44 which snap fits over a radially outwardly directed circumferentially extending rib or bead 46 on the exterior neck 48 of the container 50 to normally hold the cap in place. The container 50 as illustrated has a body portion 52, the reduced neck 48, and a radially outwardly directed flange 54 spaced downwardly a small axial distance from the axial end face of the neck defining the discharge opening. This flange 54 has a notched recess or gap 60. The cap has a radially outwardly directed removal tab 62 which when aligned with the gap permits pivoting action of the cap to remove it. More specifically, the thumb of the user simply engages below the removal tab 62 when it is aligned or registers with the gap 60 and then an upward prying motion disengages the cap from the container. The cap is simply reapplied by positioning it over the mouth of the container and pressing it downwardly so that the bead 46 snap fits into the groove 42 on the inner wall of the skirt of the cap. Note also that the axial height H of the flange on the container relative to the height H1 of the skirt is such that the removal tab lies almost flush against the flange on the container and the outer axial end face of the mouth of the container engages the top of the cap to provide a seal therebetween.

In accordance with the present invention, tamper-evident means is provided to provide visual indicia means to the user when the cap has once been removed. The tamper-evident feature consists broadly of a removable portion of the cap connected by scoring and having a locking means so that it is virtually impossible to remove the cap without fracturing the scored areas connecting the removable portion to the cap. Accordingly, a user simply examines the cap and if the removable portion is intact, the contents have not been tampered with. On the other hand if the removable portion has been even partially scored, this will serve as an alert to the user that the cap may have been once removed thereby permitting access to the contents and possible tampering therewith. More specifically, the container is provided in the present instance with a series of circumferentially spaced lug members 80 at the juncture of the neck of the container and flange 54. In the present instance, the lug members 80 consist of four circumferentially equally spaced lugs $80^a$, $80^b$, $80^c$ and $80^d$, three of the lugs being of the same short arcuate length L1 and the fourth lug being of a longer arcuate length L2. One of the smaller lugs $80^a$ is located at the gap or recess 60 in the flange 54 of the container. The lower inner terminal edge of the skirt 44 of the cap is provided with a groove 88 running for most of its circumference which closely overlies the lugs 80. A portion of the lower edge of the skirt defines a tear-away or anti-turn band 90 normally connected to the and formed integrally with the skirt by a score line as at 92. The band 90 has a tear away tab 94 adjacent one terminal end thereof to facilitate gripping by the user to remove the tear band when it is desired to remove the cap to gain access to the contents. The groove 88 in the lower terminal edge of the skirt which straddles the lugs continues into a portion of the tear band as at 96. The remaining portion 98 engages between the lugs formed on the container when the cap is applied to the container and prevents full rotational movement of the cap relative to the container. The removal tab 94 is positioned relative to the tear band 90 so that it is not in registry with the gap or recess in the container flange when the tear band is located between adjacent lugs in any one of the four quadrants defined by the lugs on the container flange. Of course, removal of the tear band 90 now effectively defines a continuous groove 102 in the lower inside edge of the skirt thereby permitting free rotational movement of the cap relative to the container so that the removal tab 62 may be positioned in registry with the gap 60 and situated to remove the cap when desired.

While particular embodiments of the present invention have been illustrated and described herein, it is not intended to limit the invention and changes and modifications may be made therein within the scope of the following claims.

What is claimed is:

1. A tamper-evident closure and container, comprising a container having a discharge opening at one end and a closure having a skirt and a wall member spanning the opening, interengaging locking means between the skirt of the closure and the container opening, a tab projecting radially outwardly from the skirt registrable with a gap in a radially outwardly directed flange of the container, a fracturable tear band portion forming only a portion of the peripheral side wall of the closure skirt and having locking means cooperative with locking means on the container normally preventing relative rotation of the closure and container, removal of said tear band portion permitting relative rotation to align said tab with said gap permitting removal of said closure by pressure upward directly on said tab.

2. A tamper-evident closure and container as claimed in claim 1, including a series of lugs projecting radially outwardly from the exterior neck of the container, one of said lugs having a circumferential dimension greater than the other lugs.

3. A tamper-evident closure and container as claimed in claim 2, wherein said fracturable tear band portion has a radially inwardly directed rib which normally engages between the lugs on the container and limits rotational movement of the cap relative to the container so that when the tear band is intact, outwardly projecting tab is not aligned with the gap.

4. A tamper-evident closure and container as claimed in claim 1, wherein said interlocking means includes a series of axially extending ribs on the interior wall of said container adjacent said discharge opening and wherein said removable band portion has complementary ribs which normallly interengage with the ribs on the container to prevent relative rotation of the cap and container.

* * * * *